United States Patent [19]

Ohno

[11] 4,240,229

[45] Dec. 23, 1980

[54] IMMERSION TYPE GRINDING APPARATUS

[76] Inventor: Ietatsu Ohno, 1-2, 1-chome, Kasuya, Setagaya-ku, Tokyo, Japan

[21] Appl. No.: 964,963

[22] Filed: Nov. 30, 1978

[51] Int. Cl.[3] ..... B24B 31/00

[52] U.S. Cl. ..... 51/7; 51/19

[58] Field of Search ..... 51/6, 7, 17, 19, 317, 51/319

[56] References Cited

U.S. PATENT DOCUMENTS

| | | | |
|---|---|---|---|
| 1,733,192 | 10/1929 | Haber | 51/7 X |
| 2,425,640 | 8/1947 | Pruitt | 51/7 |
| 2,915,852 | 12/1959 | Wabeke | 51/7 |
| 3,516,203 | 6/1970 | Hambright | 51/19 X |
| 4,034,515 | 7/1977 | Ohno | 51/19 X |

*Primary Examiner*—Gary L. Smith

[57] ABSTRACT

A vertically arranged circular or polygonal grinding tank and shafts which are fixed to or rotatably formed on a main shaft plate provided rotatably above the grinding tank are provided. The grinding tank is charged with such proper grinding material as hone grains or a medium and workpieces are held or suspended from the shafts and are submerged and moved into the grinding material. The main shaft plate is rotated, and the shafts are stopped, rotated or moved through different angles. Either or both of the grinding tank and main shaft plate is or are moved up and down so that the workpieces may be ground by the frictional slide and flow of the grinding material. Thus, workpieces and particularly large workpieces can be uniformly ground within a short time and a multi-purpose grinding can be made.

3 Claims, 3 Drawing Figures

IMMERSION TYPE GRINDING APPARATUS

BACKGROUND OF THE INVENTION

1. Field of the Invention:

The present invention relates to a grinding method and apparatus wherein mostly parts of industrial machines and tools and particularly such peculiarly shaped mechanical parts so far unable to be ground as, for example, large parts more than one meter long of mufflers for motorcycles can be ground.

2. Description of the Prior Art:

Such a large article as a muffler has been in the prior art substantially manually ground with buffs. For example, even if an automatic buffer is utilized, as the grinding has a direction and grinding shade, it will be very difficult to uniformly grind the entire surface of a peculiarly shaped or large article. Even if many buffer units are utilized, no sufficient grinding will be obtained, a high cost will be required for the units and jigs, and further a manual buffing will have to be finally applied.

SUMMARY OF THE INVENTION

An object of the present invention is to provide a grinding method and apparatus wherein such conventional problems are solved and a grinding material is pressed into contact with works along their shapes and figures so that the workpieces may be uniformly ground within a short time by the slide and frictional flow with the grinding material.

DETAILED DESCRIPTION OF PREFERRED EMBODIMENTS

Figure 1:
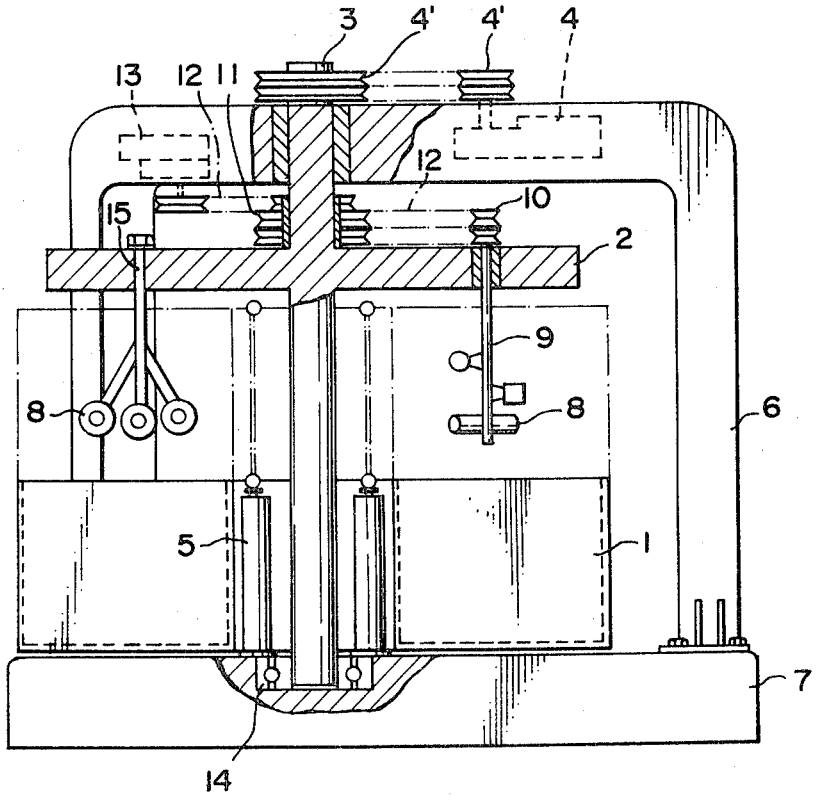
FIG. 1 is a partly sectioned elevation of a grinding apparatus showing an embodiment for working the method of the present invention.
Figure 2:
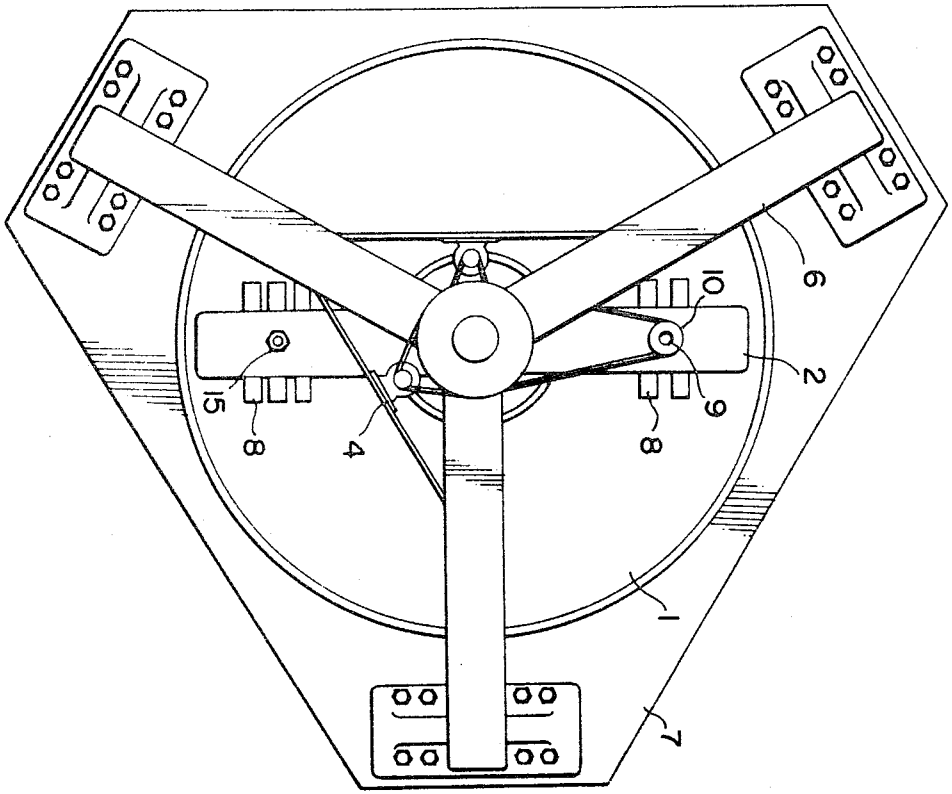
FIG. 2 is a plan view of FIG. 1.

Fig. 1 is a partly sectioned elevation showing a grinding apparatus for embodying the method of the present invention. FIG. 2 is a plan view of the same. In the drawings, 1 is a vertically arranged circular or polygonal grinding tank formed to be doughnut-shaped (ring-shaped) and provided on a mount body 7. The grinding tank 1 is charged with such grinding material as hone grains, a grinding medium or chips depending on the object. This tank 1 is supported with guides not illustrated and shaft column 3 fixed to be integral and incorporated into a bearing 14 provided in the mount body 7. A bearing is provided also in an arch frame 6 and the main shaft column 3 is borne with these upper and lower bearings so as to be rotatable through a main shaft motor 4 and its driving devices 4'. As required, a structure wherein the main shaft plate 2 formed on the main shaft column 3 is made movable up and down instead of the grinding tank may be also used.

Then, shafts 9 to which workpieces 8 are to be fitted are fixed to or rotatably formed on the main shaft plate 2 and the workpieces 8 are fitted to the tips of the shafts 9. Then, when the grinding tank 1 charged with the grinding material in advance is moved upward with the hydraulic cylinders 5, the workpieces 8 will move and submerge into the grinding tank charged with the grinding material. When the main shaft motor 4 is rotated to rotate the main shaft column 3 and main shaft plate 2 through the main shaft motor pulleys 4' and power transmitting belts, the workpieces 8 will be pressed into contact with the grinding material within the grinding tank by this parallel rotary motion and will be ground by the friction and sliding flow by the rotation. At this time, if any rotation is given to the workpieces 8, for example, by the power of a motor 13 fitted to the arch frame 6 through power transmitting pulleys 11 and belts 12 by fixing pulleys 10 to the shafts 9 giving a rotation or movement to the workpieces effective grinding high will take place.

If, as another method, for example, the power transmitting pulleys 11 are stopped as fixed to the arch frame 6 without using the motor 13 and power transmitting belts 12, the power transmitting pulleys 11 fixed to the arch frame 6 will be stationary and therefore will rotate in the reverse direction when the main shaft plate 2 rotates. Therefore, by the rotary movement of the main shaft plate 2, the pulleys 10 fixed to the shafts 9 will be rotated through the power transmitting belts 12 without using any particular power transmitter and the workpieces will be rotated.

In case the numbers of revolutions of the main shaft plate 2 and shafts 9 must be made different, increased or decreased, any difference in the number of revolutions will be able to be made by making the diameters of the power transmitting pulleys 11 and 10 different to be large or small.

Further, particularly, in the case of grinding at a high speed rotation, the grinding material or the like within the tank will spring out of the tank. Therefore, in order to prevent it, the main shaft plate 2 or main shaft column 3 is provided with a lid for the grinding tank 1 so that the lid may be so close to the surface of the tank as to prevent the grinding material or the like from springing out. Particularly, at the time of a number of revolutions at which a strong centrifugal force is generated within the tank, when the flow of the grinding material is pressed with the lid, the pressure will become high, the density of such grinding material as hone grains will be increased and greater grinding will be obtained.

Figure 3:
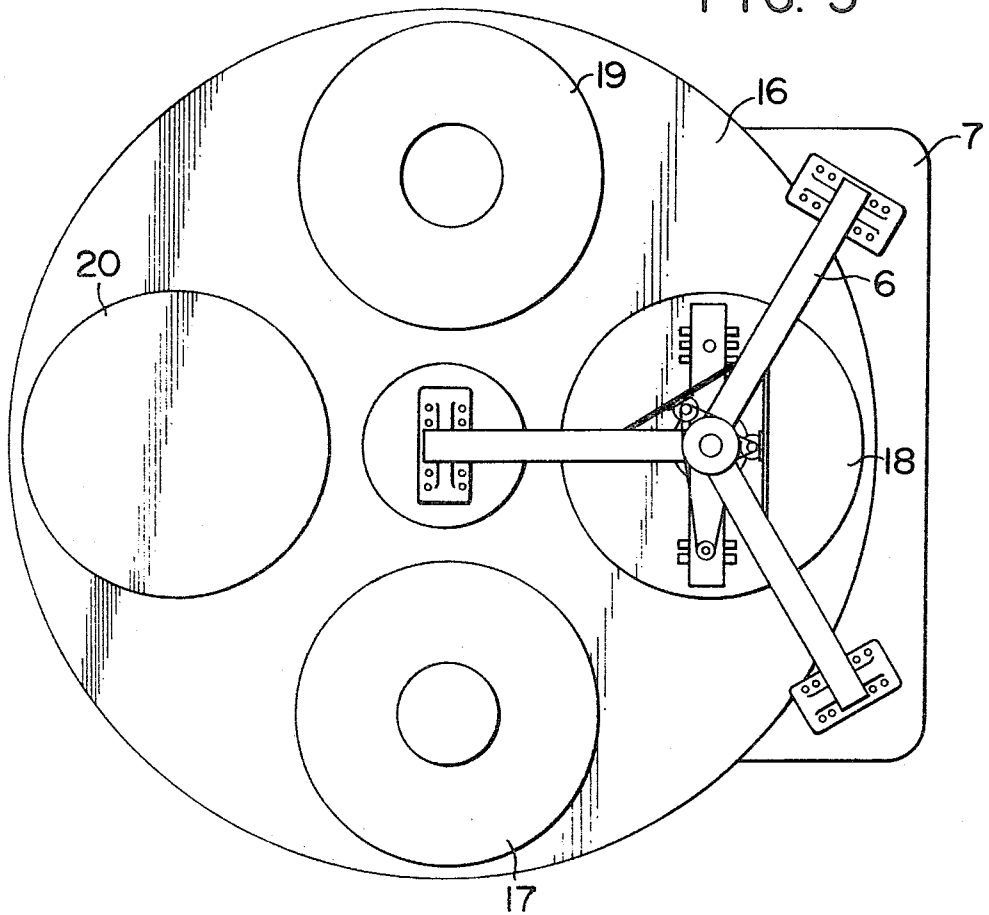
FIG. 3 is a plan view of a grinding apparatus of another embodiment.

FIG. 3 is of a grinding apparatus showing another embodiment of the grinding method of the present invention. It is of a multi-tank type wherein a plurality of grinding tanks shown in FIG. 1 are used as a first grinding tank 17, second grinding tank 18 and third grinding tank 19 so that a coarse finish to precise finish may be made and a bed body having these grinding tanks is made movable in a parallel or peripheral direction (a peripherally moving type is shown in the drawing) and a work fitting and removing service station 20 is provided so that an entire automation may be possible. Needless to say, in such case, if the supporting shaft column 3 is made movable up and down or the arch frame 6 is made movable up and down, for example, with hydraulic cylinders, the grinding effect will be higher. By the way, the grinding operation will be the same as in the above mentioned embodiment.

As explained above, according to the method of the present invention, a grinding tank having shafts for fitting workpieces provided in a main shaft plate, having the workpieces fitted to or suspended from the shafts and charged with a grinding material in advance is moved upward with hydraulic cylinders while rotating the main shaft plate within the grinding tank so that the workpieces may be submerged into the grinding material and may be rotated within the grinding tank by the rotation of the main shaft plate through an electric driving device so as to be slid, rotated, submerged and flowed to be uniformly frictionally ground within a short time. By the way, the rotation can be made a high speed rotation, low speed rotation, normal rotation or reverse rotation depending on the required object. The workpieces can be rotated or can be changed in the direction or angle in the grinding material. Therefore, the grinding is possible in a wide multipurpose range.

I claim:

1. Grinding apparatus comprising in combination, a grinding tank disposed about a central axis having grinding materials therein and presenting an open mouth for receiving materials to be ground therein, a rotatable main shaft mounted substantially along the central axis of said tank and having a plate integral therewith providing a movable cover plate extending over substantially the entire mouth of said tank, a first drive means for rotating said shaft and plate at various speeds, a plurality of workpiece shafts adapted to hold workpieces extending from said plate to enter said tank off center about said axis, and means relatively vertically moving said tank and shaft plate with its rotatable shafts to thereby enter workpieces into the grinding materials where the materials slide and flow about the workpieces as the main shaft is rotated at various selected speeds of rotation with the mouth of said tank substantially closed and to remove the workpieces from the grinding materials by lifting the cover plate and workpiece shafts from said tank including at least some of said workpiece shafts mounted for rotation in said plate, and further drive means for continuously rotating said rotatable workpiece shafts at selected speeds independently from the speed of rotation of said main shaft.

2. Apparatus as defined in claim 1 wherein the rotatable workpiece shaft extends substantially vertically through the plate with rotating means on one side and workpieces on the other side.

3. Apparatus as defined in claim 2 wherein the main shaft is rotatably supported at one end in an arch frame extending above the tank and is rotatably supported at the other end in a bearing mounted on a tank support body, and the tank is ring shaped with said main shaft extending through the center of the ring, wherein said tank sets on said support body.

* * * * *